United States Patent [19]

Edmonston

[11] 4,442,046

[45] Apr. 10, 1984

[54] CARBURETOR

[76] Inventor: William H. Edmonston, 22021 Trailway, El Toro, Calif. 92630

[21] Appl. No.: 364,059

[22] Filed: Mar. 31, 1982

[51] Int. Cl.[3] ..... F02M 9/06

[52] U.S. Cl. ..... 261/44 B; 261/DIG. 8; 261/DIG. 50; 261/DIG. 38; 261/72 R; 74/89.2

[58] Field of Search ..... 261/44 B, DIG. 50, DIG. 8, 261/44 C, DIG. 81, DIG. 38, 72 R; 74/89.2

[56] References Cited

U.S. PATENT DOCUMENTS

| | | | |
|---|---|---|---|
| 1,116,823 | 11/1914 | Johnson et al. | 261/DIG. 8 |
| 2,062,496 | 12/1936 | Brokel | 261/44 B |
| 2,756,033 | 7/1956 | Smith et al. | 261/44 B |
| 3,189,330 | 6/1965 | Newman | 261/34 A |
| 3,371,658 | 3/1968 | Turner | 261/DIG. 8 |
| 3,494,343 | 2/1970 | Nutten | 261/DIG. 8 |
| 3,709,469 | 1/1973 | Edmonston et al. | 261/44 B |
| 3,822,058 | 7/1974 | Carter | 261/44 B |
| 3,943,207 | 3/1976 | Harootian | 261/44 A |
| 3,985,839 | 10/1976 | Edmonston | 261/44 B |
| 4,013,741 | 3/1977 | Edmonston | 261/44 B |
| 4,041,797 | 8/1977 | Mito | 261/44 B |
| 4,150,070 | 4/1979 | Hashimoto et al. | 261/44 B |
| 4,168,289 | 9/1979 | Saunion | 261/DIG. 50 |
| 4,170,146 | 10/1979 | Owens | 74/89.2 |
| 4,221,747 | 9/1980 | Edmonston | 261/44 B |
| 4,366,722 | 1/1983 | Hasler | 74/89.2 |

FOREIGN PATENT DOCUMENTS

| | | | |
|---|---|---|---|
| 158754 | 5/1940 | Fed. Rep. of Germany | 261/44 B |
| 747986 | 10/1944 | Fed. Rep. of Germany | 261/44 B |
| 2924054 | 12/1980 | Fed. Rep. of Germany | 261/44 C |
| 972281 | 1/1951 | France | 261/44 B |
| 54-108130 | 8/1979 | Japan | 261/44 C |
| 152442 | 10/1920 | United Kingdom | 261/44 B |
| 201967 | 8/1923 | United Kingdom | 261/44 B |

*Primary Examiner*—Tim R. Miles

*Attorney, Agent, or Firm*—Jacobi, Siegel, Presta, Marzullo & Aronson

[57] ABSTRACT

A carburetor comprising a body defining a throat, a throttle slide member slidably mounted on the body and disposed in the throat, a rotary actuator for the slide member, and a tapered metering rod or needle mounted on the slide member and extending downwardly into a fuel supply tube leading into a sealed and pressurized fuel reservoir or bowl secured to the body. The slide member has front and rear, substantially flat panels disposed in substantially parallel relation, with the front panel being shorter than the rear panel for the purpose of providing air at the outlet of the fuel supply tube even when the slide is in a closed position and for directing air toward and around the outlet when the slide is in an open position. The bottom of the rear panel has a cut-out portion in alignment with the metering rod and fuel outlet at the throat for the purpose of directing high speed air flow toward the metering rod and around the fuel outlet. The metering rod is provided with a downwardly and inwardly tapered, rear flat face and is mounted for longitudinal adjustment relative to the slide member. A shroud surrounds the forward face of the rod adjacent the fuel outlet to reduce turbulence, and an air supply channel surrounds the fuel outlet to promote a balanced system and an optimum fuel-air ratio.

6 Claims, 12 Drawing Figures

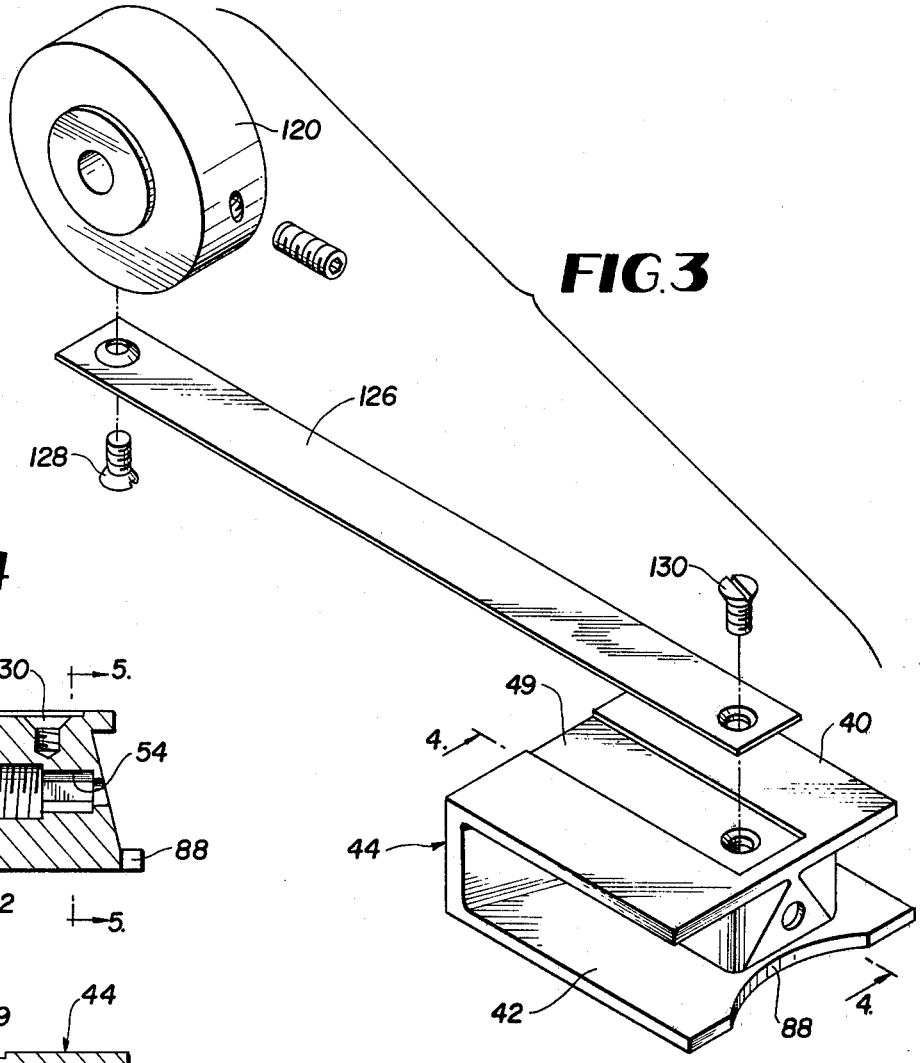
FIG.3
FIG.4
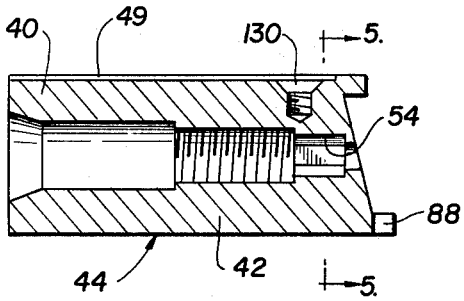
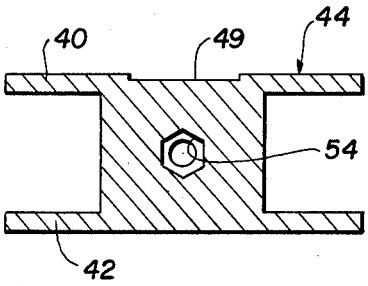
FIG.5
FIG.7
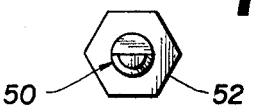
FIG.6
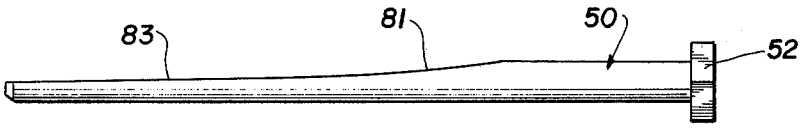

FIG.9
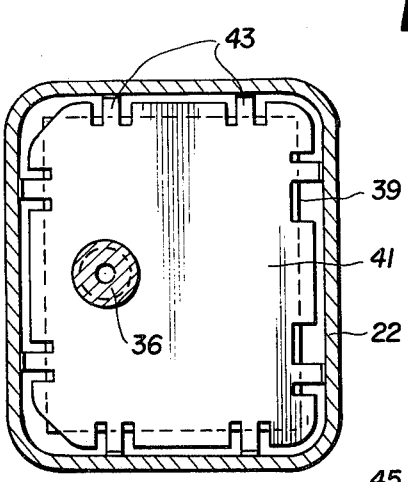
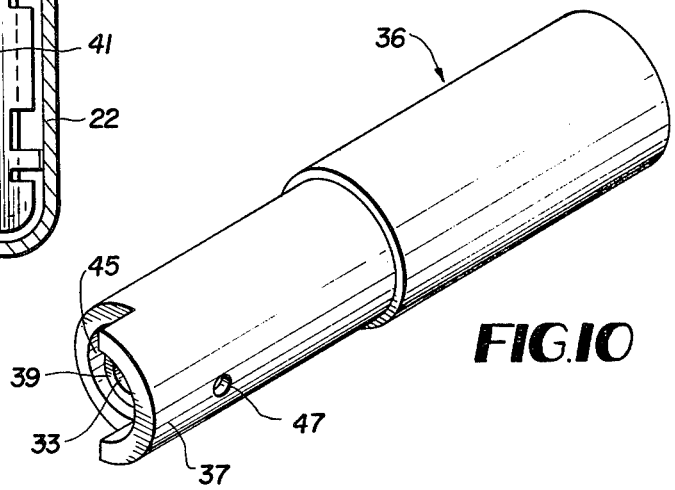
FIG.10
FIG.11
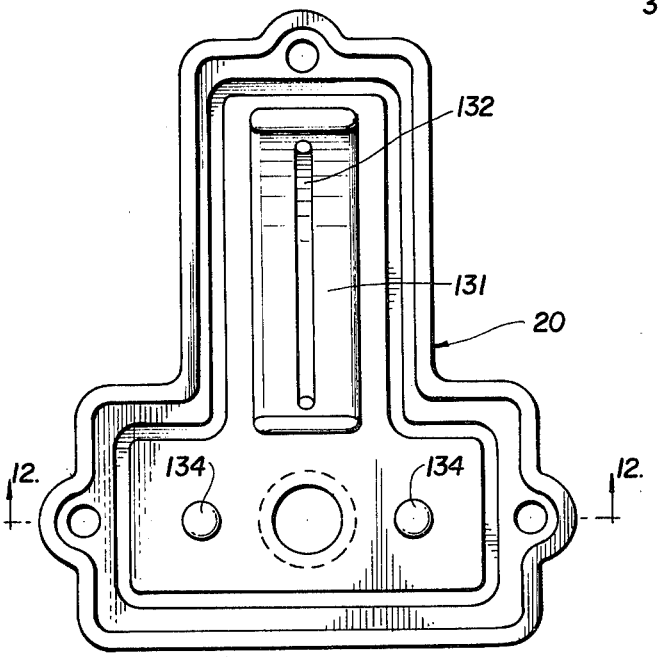
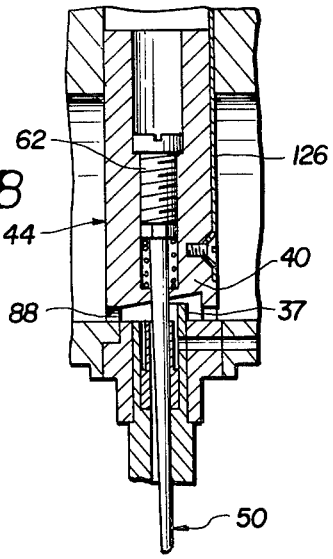
FIG.8
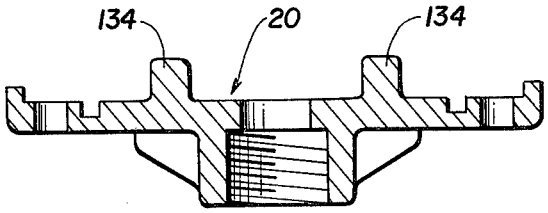
FIG.12

CARBURETOR

BACKGROUND OF THE INVENTION

The present invention relates to a carburetor construction and, more particularly, to a carburetor of the slide and metering rod type which is generally like those disclosed in my prior U.S. Pat. Nos. 3,985,839, 4,013,741 and 4,221,747. The carburetor of the present invention is constructed to maximize the flow of air in the vicinity of the metering rod and fuel outlet to assure thorough atomization and distribution of the fuel in the airstream before it reaches the combustion chamber, thereby minimizing the possibility of fuel droplets leaving the airstream and condensing on the wall of the fuel passage.

Although previously used and disclosed carburetors of the slide and metering rod type have generally served the purpose, these carburetors have been subject to one or more of the following disadvantages:

(1) Insufficient atomization and distribution of the fuel in the airstream;

(2) Insufficient flow of air in the vicinity of the fuel outlet and metering rod;

(3) Insufficient choke arrangement;

(4) Poor design of metering rod or needle;

(5) Difficulty in mounting and adjustment of metering rod or needle;

(6) Unbalanced and non-uniform air-fuel mixture;

(7) Turbulent and inconsistent fuel flow when vehicle is subjected to rough terrain; and/or (8) Difficult to assemble or repair.

Accordingly, it will be readily seen that a need has arisen for a new and improved carburetor of the slide and metering rod type which is not subject to any of the above-mentioned disadvantages. The carburetor of the present invention fills this need and possesses certain improvements and advantages which are not embodied in the prior art carburetors of this type.

SUMMARY OF THE INVENTION

A carburetor comprising a body defining a throat, a throttle slide member slidably mounted on the body and disposed in the throat, a rotary actuator for the slide member, and a tapered metering rod or needle mounted on the slide member and extending downwardly into a fuel supply tube leading into a sealed and pressurized fuel reservoir or bowl secured to the body. The slide member has front and rear, substantially flat panels disposed in substantially parallel relation, with the front panel being shorter than the rear panel for the purpose of providing air at the outlet of the fuel supply tube when the slide is in a closed position and for directing air toward and around the outlet when the slide is in an open position. The bottom of the rear panel has a cut-out portion or recess in alignment with the metering rod and fuel outlet at the throat for the purpose of directing high speed air flow toward the metering rod and around the fuel outlet.

The metering rod is provided with a downwardly and inwardly tapered, rear flat face and is mounted for longitudinal adjustment relative to the slide member. A shroud surrounds the forward face of the rod adjacent the fuel outlet to reduce turbulence. The fuel supply tube is provided with an annular recess beneath the shroud and a portion of the air entering the throat is diverted to this annular recess through an opening in the throat for the purpose of promoting a balanced system and an optimum fuel-air ratio.

A manually operable, normally closed fuel primer is provided in the throat rearwardly of the metering rod for supplying supplemental fuel when the carburetor is first actuated. This fuel primer eliminates the need for a choke and serves to reduce the amount of supplemental fuel that would be used by a conventional choke.

For the purpose of preventing turbulence in the fuel reservoir or bowl, eliminating air bubbles in the fuel and insuring a constant fuel flow even when the vehicle is subjected to rough terrain, a porous member or fuel cell is provided on the bottom of the fuel reservoir in engagement with the lower end of the fuel supply tube. The fuel cell is formed of a material that will absorb the fuel but not water. Any suitable means may be provided for retaining the porous member in place at the bottom of the fuel reservoir, such as an overlying plate or the like. The plate serves to trap the fuel in the fuel cell.

BRIEF DESCRIPTION OF THE DRAWINGS

FIG. 3 is an enlarged, exploded perspective view of the slide member of the present carburetor and a portion of the rotary actuating assembly for moving the slide member;

FIG. 4 is a sectional view taken substantially along line 4—4 in FIG. 3;

FIG. 5 is a sectional view taken substantially along line 5—5 in FIG. 4;

FIG. 6 is a side elevational view of one embodiment of a fuel metering rod for the present carburetor;

FIG. 7 is an end view of the metering rod shown in FIG. 6;

FIG. 8 is a side elevational view in section of a portion of the carburetor as shown in FIG. 2, with the slide member in the closed position;

FIG. 9 is a sectional view taken substantially along line 9—9 in FIG. 2;

FIG. 10 is an enlarged perspective view of the fuel supply tube assembly for the present carburetor;

FIG. 11 is a bottom plan view of the cover for the body of the present carburetor; and FIG. 12 is a sectional view taken substantially along line 12—12 in FIG. 11.

DESCRIPTION OF THE PREFERRED EMBODIMENTS

Figure 2:
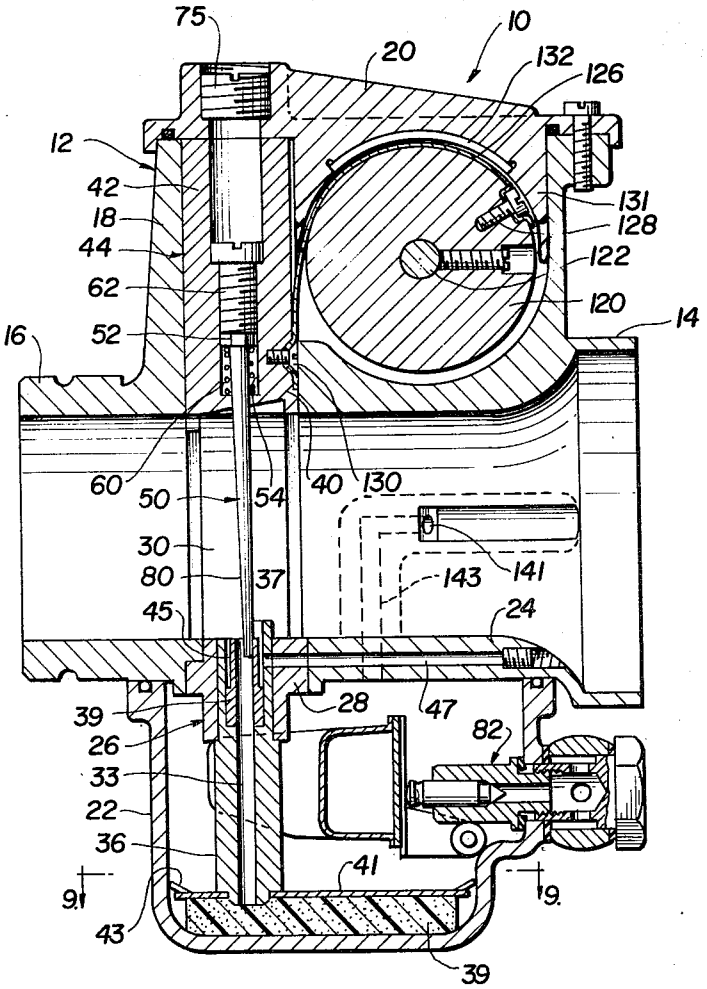
FIG. 2 is a sectional view taken substantially along line 2—2 in FIG. 1.
Figure 1:
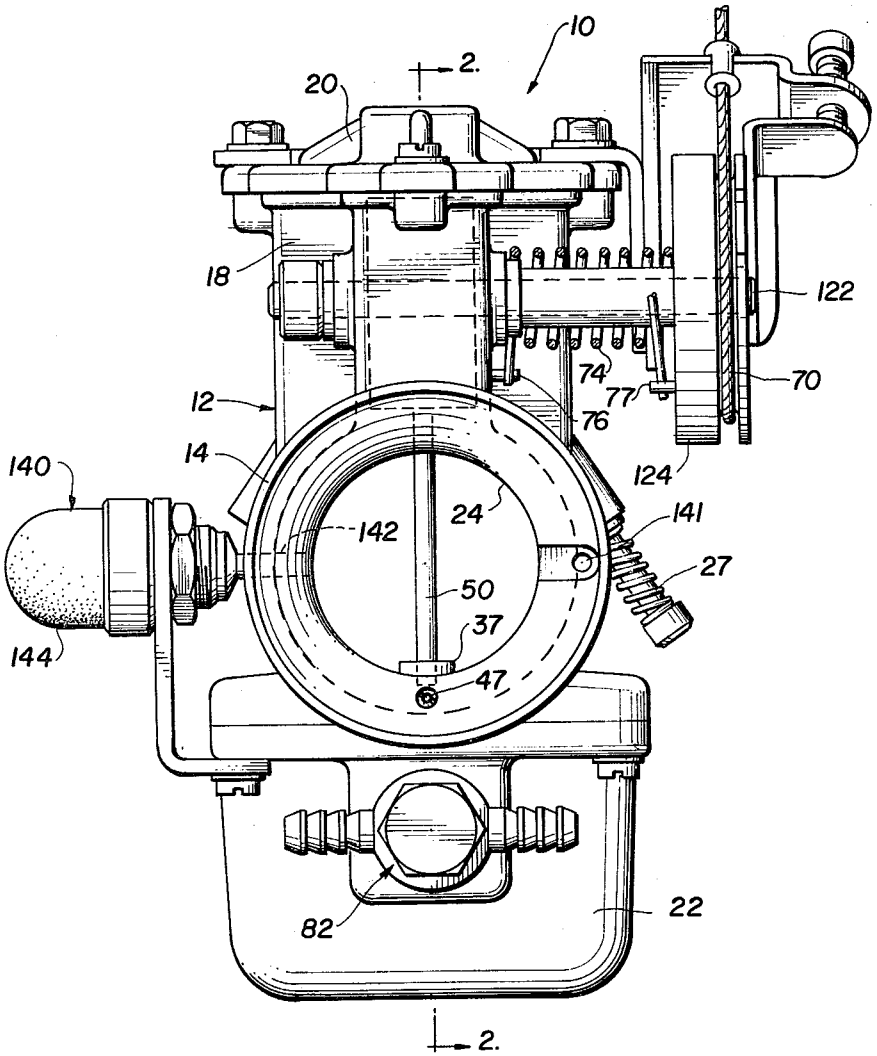
FIG. 1 is a front elevational view of a carburetor constructed in accordance with the principles of the present invention.

Referring to FIGS. 1 and 2, the carburetor 10 of the present invention generally comprises a body 12 having an air inlet end 14, an air outlet end 16 and a centrally located slide supporting portion 18; a cover 20 adapted to fit over the upper portion of the slide supporting portion 18; and a fuel reservoir or bowl 22 secured to the underside of the body beneath the slide supporting portion. Preferably, the inlet end 14, outlet end 16 and slide supporting portion 18 are formed of unitary construction, and a throat 24 extends through the body from one end to the other. The cover 20 and reservoir 22 may be removably secured to the body 12 in any suitable manner.

As shown in FIGS. 3, 4 and 6 of my U.S. Pat. No. 4,221,747, the disclosure of which is incorporated herein by reference, the body 12 is provided with an insert 26 fixedly mounted in any suitable manner within the slide supporting portion 18. The insert 26 comprises an upper portion 28 having an aperture 30 therethrough that corresponds in size and shape to the adjacent portions of the throat 24 in the body 12. The upper end of the upper insert portion 28 is open and comprises oblique end faces (not shown), one of which may have a threaded aperture (not shown) extending therethrough which is adapted to receive an idle stop screw 27 which serves to control the idle position of the throttle slide member 44 in a manner to be described hereinafter. A fuel supply tube 36 is secured to the bottom of the upper portion 28 and extends through an aperture therein into communication with the aperture 30. The fuel supply tube 36 extends downwardly into the fuel reservoir or bowl 22 into engagement with a porous member or fuel cell 39 at the lower end of the bowl 22 for a purpose to be more fully described hereinafter.

As shown in FIG. 2, the insert 26 is narrower than the adjacent portions of the slide supporting portion 18 so as to define grooves on each side of the slide supporting portion that are adapted to slidably receive the side edge portions of the front and rear panels 40 and 42 of a throttle slide member 44 mounted within the slide supporting portion 18 for substantially vertical slidable movement therein. At its upper portion, the slide member 44 is provided with a pair of downwardly facing oblique surfaces 46 (see U.S. Pat. No. 4,221,747) which are adapted to engage the complementary oblique faces 32 on the upper end of the insert 26 for the purpose of limiting the downward movement of the slide member 44 within the slide supporting portion 18 of the body 12. The idle stop screw 27 can be adjusted to engage one of the oblique surfaces (not shown) on the slide member 44 for the purpose of adjusting the lowest or idle position of the slide member. The insert 26 may be retained within the slide supporting portion 18 by any suitable means such as locking screws, locking pins or the like.

A fuel metering rod or needle 50 is adjustably secured to and extends downwardly from the slide member 44 into the central opening 33 of the fuel supply tube 36. The metering rod 50 is provided with an enlarged hexagonal head portion 52 at its upper end which is slidably received within a complementary hexagonal internal bore 54 within the slide member 44 for the purpose of maintaining the metering rod 50 in a desired orientation which will be more fully described hereinafter. A coil spring 60 or other biasing means is provided between the bottom of the slide member bore 54 and the lower surface of the head portion 52 of the metering rod 50 and serves to urge the head portion 52 upwardly away from the lower end of the bore 54, as specifically shown in FIG. 2.

An adjusting screw 62 is threadably mounted within an upper threaded portion of the slide member bore 54 and has a lower end in engagement with the upper surface of the enlarged head portion 52 of the metering rod 50 for the purpose of adjusting the position of the metering rod 50 relative to the slide member 44. The adjusting screw 62 is accessible through an opening in the cover 20 which is normally closed by a threaded plug 75. As shown in FIG. 1, a helical spring 74 serves to urge the slide member 44 to the closed or down position shown in FIG. 8 in a manner to be more fully described hereinafter. Upward movement of the slide member 44 against the force of the spring 74 allows airflow through the throat 24 and upward movement of the fuel from the reservoir 22 through the fuel supply tube 36 in a manner to be described more fully hereinafter.

Preferably, vertical movement of the slide member 44 is controlled by a rotary actuating member or wheel 120 that is disposed within the upper portion of the carburetor body 12 and is secured to a rod or axle 122 that is rotatably mounted on the carburetor body 12. As shown in FIG. 1, a second wheel or pulley 124 is secured to the outer end of the axle 122. One end of a control cable 70 is secured to the pulley 124 and the other end of the cable 70 is connected to any suitable type of manual control means (not shown) disposed on the vehicle in which the carburetor 10 is mounted. It will be readily seen, therefore, that movement of the control cable 70 results in rotation of the pulley 124, the axle 122 and the rotary actuating member or wheel 120.

An elongated flexible connecting strip 126, preferably formed of metal or another suitable material and having a concave or curved cross section, surrounds the wheel 120 and is connected at one end to the wheel 120 by suitable means such as screws 128. The other end of the connecting strip 126 is secured to the front panel 40 of the throttle slide member 44 by suitable means such as screws 130 and is positioned in a recessed portion 49 so as to be flush with the front panel 40. In this manner, rotation of the wheel 120 results in sliding movement of the slide member 44 within the slide supporting portion 18. The position of the slide member 44 in the carburetor 10, therefore, is controlled by the cable 70 through the pulley 124, axle 122, wheel 120 and connecting strip 126. The helical spring 74, which urges the slide member 44 to the closed or down position, surrounds the axle 122 and has its ends in engagement with stops 76 and 77 or the like on the supporting portion 18 and the pulley 124, respectively, as shown in FIG. 1. This rotary actuating assembly for the slide member 44 provides a positive and reliable push-pull arrangement for opening and closing of the slide member and enables it to be accurately positioned where desired with respect to the throat 24 of the carburetor, even if the biasing spring 74 were to break.

As shown in FIGS. 2 and 9–11, the cover 20 is provided with a portion 131 having a curved inner surface closely adjacent the upper portion of the wheel 120 with an elongated, curved insert 132 mounted therein and being formed of a suitable anti-friction material such as Nylon or Teflon for preventing wear of the connecting strip 126 because of its engagement therewith. Preferably, the cover portion 131 extends around the upper half of the wheel 120 to maintain the connecting strip 126 in close contact therewith. The cover 20 is also provided with a pair of depending stop portions 134 disposed above the throttle slide member 44 for limiting the upper movement and defining the fully open position thereof, thereby controlling maximum air and fuel flow.

Within the scope of the present invention, the rotary actuating member or wheel 120 may be connected to the throttle slide member 44 by a flexible cable connection, by a rack and pinion connection or by another suitable type of connection.

The vertical position of the metering rod or needle 50 relative to the slide member 44 may be easily adjusted by rotation of the adjusting screw 62 which is provided at its upper end with a transverse recess or the like for receiving the head of a screwdriver or similar tool. Rotation of the adjusting screw 62 serves to move the head portion 52 of the metering rod 50 upwardly or downwardly within the lower portion of the bore 54 in the throttle slide member 44 to control idle or mid-range operation of the carburetor.

In one embodiment of the present invention shown in FIGS. 2 and 6, the metering rod or needle 50 is provided with a downwardly and inwardly tapered flat portion 80 extending from the upper portion to the lower end thereof. The enlarged hexagonal head portion 52 of the metering rod 50 is so located the hexagonal bore 54 that the flat portion 80 faces the outlet end 16 of the carburetor body 12 when the metering rod 50 is mounted within the throttle slide member 44, as specifically shown in FIG. 2. It will be readily seen, therefore, that upward movement of the slide member 44 and corresponding upward movement of the metering rod 50 within the fuel supply tube 36 will cause a gradually larger opening at the outlet of the fuel supply tube for the supply of fuel from the fuel reservoir or bowl 22 to the carburetor throat 24, owing to the tapered flat portion 80 on the metering rod. By varying the taper of the flat portion 80 on the metering rod 50, the amount of fuel flow for a given upward movement of the slide member 44 and metering rod 50 may be adjusted. As shown in FIG. 6, the taper of the flat portion 80 may be formed by both a curved line 81 and a straight line 83 which merges smoothly into the curved line 81 for more precise control of idle, low speed and mid-range operation.

Referring to FIG. 2, a Venturi effect is created when air flows through the carburetor throat from the inlet to the outlet end. This airflow past the metering rod 50 and outlet end of the fuel supply tube 36 serves to create a vacuum at the outlet of the fuel supply tube, thereby causing a flow of fuel from the fuel reservoir or bowl upwardly through the opening 33 in the fuel supply tube defined by the metering rod 50 and into the carburetor throat 24 where the fuel is mixed with incoming air and moves toward the outlet end therewith. The fuel flows upwardly from the fuel reservoir 22 into the fuel supply tube 36 because the reservoir 22 is sealed and pressurized by air entering an air inlet opening 141 in the throat near the inlet end 14 and flowing through an air channel 143 into the fuel reservoir 22.

The fuel reservoir bowl 22 is provided with a suitable float valve assembly 82 or any other suitable means for maintaining a minimum quantity of fuel in the reservoir. The float valve assembly 82 is connected to a fuel supply tube (not shown) in any suitable manner.

As shown in FIGS. 2 and 7, a porous member or fuel cell 39, formed of any suitable material which will absorb a fuel such as gasoline but not water, is positioned at the bottom of the fuel reservoir 22 and is in engagement with the lower end of the fuel supply tube 36. The fuel cell 39 preferably is removably held in position in the lower end of the fuel reservoir by a plate 41 having flexible fingers 43 or the like for frictionally engaging the adjacent inner surface of the fuel reservoir. The fuel cell 39 serves to prevent turbulence in the fuel reservoir, to eliminate air bubbles in the fuel and to provide a constant fuel flow even when the vehicle in which the carburetor 10 is mounted is subjected to rough terrain. As the fuel passes from the reservoir 22 through the fuel cell 39 and into the lower end of the fuel supply tube 36, it is trapped within the fuel cell 39 by the overlying plate 41 so as to prevent turbulence or aeration thereof.

It will be appreciated that upward and downward movement of the throttle slide member 44, as actuated in a push-pull manner by the control cable 70 and rotary actuator member 120, serves to control the air flow from the inlet end 14 to the outlet end 16 of the carburetor body 12 and also serves to control the flow of fuel from the fuel reservoir or bowl 22 to the carburetor throat 24 because of corresponding upward or downward movement of the metering rod 50 secured to the throttle slide member 44.

A significant feature of the present invention is to maximize air flow past the metering rod and upper outlet end of the fuel supply tube 36 to assure a balanced distribution of the fuel in the airstream and an optimum fuel-air ratio before it reaches the combustion chamber. This is accomplished by providing the throttle slide member 44 with a lower end that is tapered downwardly from the front panel 40 to the rear panel 42 thereof, as shown in FIGS. 2–4. In other words, the front panel 40 is shorter than the rear panel 42 so that, when the throttle slide member is in a fully closed position (FIG. 8), the metering rod 50 and outlet end of the fuel supply tube 36 are exposed to air from the inlet end 14 of the carburetor body 12. In this manner, when the throttle slide member 44 is moved upwardly to open the carburetor throat 24, air is immediately present at the outlet of the fuel supply tube 36 to effect immediate mixing with the fuel drawn upwardly through the fuel supply tube. In addition, the tapering of the lower end of the throttle slide member 44 serves to direct or "tunnel" air flow downwardly toward the metering rod 50 and outlet of the fuel supply tube 36 to further enhance air flow and mixing with the fuel at this point.

Air flow around the outlet end of the fuel supply tube 36 and atomization of the fuel entering the carburetor throat at this point is further enhanced by the provision of a cut-out portion or recess 88 in the lower portion of the rear panel 42 of the slide member which is aligned with metering rod 50 and outlet of the fuel supply tube 36. The recess 88 serves to direct air flow and to concentrate it at the metering rod 50 and outlet of the fuel supply tube 36, thereby further enhancing distribution of the fuel in the airstream before it reaches the combustion chamber. In this manner, a high speed air flow is created over the metering rod and fuel supply tube outlet which is especially advantageous at idle or low engine speeds.

Referring to FIGS. 1, 2 and 8, the upper end of the fuel supply tube 36 preferably is provided with an upstanding, curved shroud portion 37 extending into the throat 24 and positioned forwardly of the metering rod 80. A tubular insert 39 is positioned within the upper portion of the fuel supply tube 36 and is recessed at its upper portion to define an annular recess 45 extending downwardly from the throat 24 and surrounding the lower end of the metering rod 50. As shown in FIG. 2, an air channel 47 extends from the throat 24 near the inlet end 14 of the carburetor to the annular recess 45 for the purpose of directing a portion of the incoming air to the annular recess 45.

The shroud portion 37 of the fuel supply tube 36 serves to provide more vacuum and reduce turbulence adjacent the upper end of the fuel supply tube and thus promotes mixing of the fuel with the incoming air and a more uniform air-fuel ratio. The air supply to the annular recess 45 surrounding the metering rod 50 and fuel supply tube opening 33 serves to promote thorough mixing of the fuel with the incoming air and optimum fuel-air ratio as it enters the throat 24 of the carburetor.

Referring to FIG. 1, and in accordance with a further aspect of the present invention, the carburetor 10 may be provided with a fuel primer device 140 which is connected to an aperture 142 extending into the carburetor throat 24 rearwardly of the metering rod 50 and fuel supply tube 36. The fuel primer device 140 is connected in any suitable manner to a fuel supply line (not shown) and preferably is manually operable by squeezing a deformable actuating member or bulb 144 to direct fuel from the fuel supply line to the aperture 142 and the throat 24 of the carburetor rearwardly of the metering rod 50. The fuel primer device 140 may be of any suitable internal construction and operation within the knowledge of those skilled in the art.

The fuel primer device 140 of the present invention rapidly and easily enrichens the fuel mixture in the throat 24 during initial operation of the carburetor without wasting fuel and makes it unnecessary to provide a choke arrangement for the carburetor, thereby simplifying the carburetor construction and avoiding the expense of a choke arrangement and the excessive fuel use resulting from typical choke arrangements known at the present time.

It is noted that the carburetor 10 of the present invention is a sealed unit. The air needed to pressurize the fuel reservoir 22 and for the annular recess 45 surrounding the fuel supply tube opening 33 comes from air inlets 140 and 47, respectively, located within the throat 24 of the carburetor.

What is claimed is:

1. A carburetor, comprising:

a body having an inlet end, an outlet end, and a throat extending therethrough from said inlet end to said outlet end, a fuel supply tube secured to the underside of said body and having an outlet in communication with said throat, a throttle slide member movably mounted on the body intermediate said inlet and outlet ends thereof for substantially transverse movement across said throat to vary the unblocked portion thereof, and a metering rod secured to said throttle slide member and extending downwardly into said fuel supply tube to control the flow of fuel therethrough, a fuel reservoir secured to and disposed beneath said body, said fuel supply tube extending downwardly into said fuel reservoir, and a fuel cell disposed on the bottom of said fuel reservoir and being adapted to absorb fuel therein, means covering the upper portion of said fuel cell to trap fuel therein, said covering means having an aperture therethrough, and the lower end of said fuel supply tube extending through said aperture into engagement with said fuel cell, whereby said fuel cell and said covering means serve to reduce turbulence in the fuel and to prevent air from entering said fuel supply tube.

2. The carburetor of claim 1 wherein said covering means comprises a plate that is impervious to the fuel in said reservoir, said plate comprising means for removably retaining it in a position over said fuel cell in said fuel reservoir.

3. The carburetor of claim 2 wherein said plate is spaced from some of the adjacent portions of said fuel reservoir to allow fuel to contact said fuel cell, and wherein said plate comprises a plurality of flexible fingers for frictionally engaging adjacent portions of said fuel reservoir to removably retain said plate therein.

4. The carburetor of claim 1 wherein said fuel reservoir is sealingly secured to said body, said throat has an air inlet opening near said inlet end, and said body has an air channel extending from said inlet opening to said fuel reservoir so that incoming air will pressurize the fuel in said reservoir.

5. A carburetor, comprising:

a body having an inlet end, an outlet end, and a throat extending therethrough from said inlet end to said outlet end, a fuel supply tube secured to the underside of said body and having an outlet in communication with said throat, a throttle slide member movably mounted on the body intermediate said inlet and outlet ends thereof for substantially transverse movement across said throat to vary the unblocked portion thereof, and a metering rod secured to said throttle slide member and extending downwardly into said fuel supply tube to control the flow of fuel therethrough, said throttle slide member comprising a substantially vertical bore therethrough and means for adjusting the position of said metering rod in a substantially longitudinal direction, said metering rod comprising a head portion at the upper end thereof, said head portion being slidable within said bore, spring means being disposed between said head portion and the bottom of said bore, and said adjusting means comprising an adjusting member movably mounted on said throttle member and disposed in the portion of said bore above said head portion of said metering rod, said adjusting member having a lower end in engagement with said head portion, whereby movement of said adjusting member in said bore effects movement of said metering rod in a substantially longitudinal direction, said head portion and said bore having complementary cross-sectional shapes comprising means which enable said head portion to be positioned in a plurality of circumferentially located positions within said bore.

6. The carburetor of claim 5 wherein said head portion and said bore are hexagonal in cross-sectional shape.

* * * * *